US010043444B2

(12) United States Patent
Park et al.

(10) Patent No.: US 10,043,444 B2
(45) Date of Patent: Aug. 7, 2018

(54) DISPLAY PANEL AND ORGANIC LIGHT-EMITTING DIODE (OLED) DISPLAY INCLUDING THE SAME

(71) Applicant: Samsung Display Co., Ltd., Yongin, Gyeonggi-do (KR)

(72) Inventors: Kyong-Tae Park, Suwon-si (KR); Mi-Jin Yoon, Daegu (KR); Yu-Hyun Cho, Seoul (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 437 days.

(21) Appl. No.: 14/594,919

(22) Filed: Jan. 12, 2015

(65) Prior Publication Data

US 2016/0035279 A1 Feb. 4, 2016

(30) Foreign Application Priority Data

Jul. 31, 2014 (KR) ..... 10-2014-0098640

(51) Int. Cl.
*G09G 3/3233* (2016.01)

(52) U.S. Cl.
CPC ... *G09G 3/3233* (2013.01); *G09G 2300/0413* (2013.01); *G09G 2320/043* (2013.01); *G09G 2330/028* (2013.01)

(58) Field of Classification Search
CPC ..... G09G 2330/08; G09G 3/3233; G09G 2330/10; G09G 2300/0413; G09G 2300/0842; G09G 2300/0819; G09G 2300/0861; G09G 2320/0233; G09G 2300/0452; G09G 2300/0426; G09G 3/32; G09G 3/3291; G09G 3/006
See application file for complete search history.

(56) References Cited

U.S. PATENT DOCUMENTS

2005/0212408 A1* 9/2005 Yoshida ..... G09G 3/3216 313/503
2005/0275352 A1 12/2005 Sun
(Continued)

FOREIGN PATENT DOCUMENTS

KR 10-0666639 B1 1/2007
KR 10-2010-0065745 A 6/2010
(Continued)

*Primary Examiner* — Kent Chang
*Assistant Examiner* — Scott Au
(74) *Attorney, Agent, or Firm* — Knobbe, Martens, Olson & Bear, LLP

(57) ABSTRACT

A display panel and organic light-emitting diode (OLED) display including the same are disclosed. In one aspect, the display panel includes an active pixel including a driving circuit configured to generate a driving current based on a data signal and an emission circuit configured to emit light based on the driving current. The display panel also includes a repair pixel including a repair driving circuit configured to provide a repair driving current to the emission circuit instead of the driving current of the driving circuit when the driving circuit is disconnected from the emission circuit. The repair pixel further includes an aging switch configured to apply an aging voltage to the repair driving circuit during an aging operation and electrically disconnect the repair driving circuit from a power supply after the aging operation is performed.

20 Claims, 8 Drawing Sheets

(56) References Cited

U.S. PATENT DOCUMENTS

| | | | | |
|---|---|---|---|---|
| 2010/0073346 | A1* | 3/2010 | Min | G09G 3/3291 345/211 |
| 2010/0238149 | A1* | 9/2010 | Kishi | G09G 3/3233 345/206 |
| 2011/0032442 | A1* | 2/2011 | van Aerle | G02F 1/136259 349/38 |
| 2012/0001893 | A1* | 1/2012 | Jeong | G09G 3/3233 345/213 |
| 2014/0240304 | A1* | 8/2014 | In | G09G 3/3233 345/212 |
| 2014/0361960 | A1* | 12/2014 | Yamauchi | G09G 3/3233 345/76 |

FOREIGN PATENT DOCUMENTS

| | | | |
|---|---|---|---|
| KR | 10-2010-0079095 | A | 7/2010 |
| KR | 10-2014-0137504 | A | 12/2014 |
| KR | 10-2015-0044328 | A | 4/2015 |
| KR | 10-2015-0107018 | A | 9/2015 |
| KR | 10-2015-0114115 | A | 10/2015 |

* cited by examiner

DISPLAY PANEL AND ORGANIC LIGHT-EMITTING DIODE (OLED) DISPLAY INCLUDING THE SAME

CROSS-REFERENCE TO RELATED APPLICATION(S)

This application claims priority under 35 USC § 119 to Korean Patent Applications No. 10-2014-0098640, filed on Jul. 31, 2014 in the Korean Intellectual Property Office (KIPO), the contents of which are incorporated herein in its entirety by reference.

BACKGROUND

Field

The described technology generally relates to a display panel and an organic light-emitting diode (OLED) display including the display panel.

Description of the Related Technology

OLED displays include a display panel having a plurality of pixels. Each pixel includes an OLED that emits light based on a driving current. Therefore, each pixel includes a driving circuit that provides the driving current to the OLED. However, the driving circuit can be damaged during the manufacturing of the OLED display.

SUMMARY OF CERTAIN INVENTIVE ASPECTS

One inventive aspect is a display panel that can i) provide a driving current to an OLED when a driving current providing part is damaged, ii) reduce the effect of a capacitance of a parasitic capacitor generated in a current providing line, and iii) generate a driving current using transistors of which the leakage current is reduced.

Another aspect is an OLED display having the display panel.

Another aspect is a display panel including a repair pixel and an active pixel. The active pixel may include an emission part configured to emit light based on a driving current and a driving current providing part configured to provide the driving current to the emission part based on a data signal. The repair pixel may include a repair driving current providing part configured to provide the driving current to the emission part instead of the driving current providing part when the driving current providing part is disconnected from the emission part, and an aging switch connecting the repair driving current providing part to a power unit that provides an aging voltage while an aging operation for the active pixel and the repair pixel is performed, and disconnecting the repair driving current providing part from the power unit that provides an initialization voltage after the aging operation is performed.

In example embodiments, the emission part may include an OLED including a first electrode and a second electrode to which a first power voltage is applied, and a capacitor connected between the first electrode and the second electrode of the OLED.

In example embodiments, a structure of the repair driving current providing part may be substantially the same as a structure of the driving current providing part.

In example embodiments, the aging voltage may be applied to the driving current providing part and the repair driving current providing part while the aging operation is performed.

In example embodiments, the aging voltage may be applied to a first transistor included in the driving current providing part and a second transistor included in the repair driving current providing part.

In example embodiments, each of the driving current providing part and the repair driving current providing part may include a driving transistor including a gate electrode, a first electrode to which a second power voltage is applied, and a second electrode, a data applying transistor including a gate electrode to which a scan signal is applied, a first electrode to which a data signal is applied, and a second electrode connected to the gate electrode of the driving transistor, a storage capacitor including a first electrode to which the second power voltage is applied and a second electrode connected to the gate electrode of the driving transistor, an emission controlling transistor including a gate electrode to which an emission signal is applied, a first electrode connected to the second electrode of the driving transistor, and a second electrode connected to the emission part, and an initialization controlling transistor including a gate electrode to which an initialization signal is applied, a first electrode to which the initialization voltage is applied, and a second electrode connected to the second electrode of the emission controlling transistor.

In example embodiments, the data applying transistor may be configured to apply the data signal to the storage capacitor when the scan signal is activated. The storage capacitor may be configured to store the applied data signal. The driving transistor may be configured to generate the driving current based on the stored data signal. The emission controlling transistor may be configured to provide the generated driving current to the emission part based on the emission signal. The initialization controlling transistor may be configured to initialize the second electrode of the emission controlling transistor with the initialization voltage based on the initialization signal.

In example embodiments, each of the driving current providing part and the repair driving current providing part may include a driving transistor including a gate electrode, a first electrode, and a second electrode, a data applying transistor including a gate electrode to which a scan signal is applied, a first electrode to which the data signal is applied, and a second electrode connected to the first electrode of the driving transistor, a threshold voltage compensation transistor including a gate electrode to which the scan signal is applied, a first electrode connected to the second electrode of the driving transistor, and a second electrode connected to the gate electrode of the driving transistor, a storage capacitor including a first electrode to which a second power voltage is applied and a second electrode connected to the gate electrode of the driving transistor, a first emission controlling transistor including a gate electrode to which an emission signal is applied, a first electrode to which the second power voltage is applied, and a second electrode connected to the first electrode of the driving transistor, a second emission controlling transistor including a gate electrode to which the emission signal is applied, a first electrode connected to the second electrode of the driving transistor, and a second electrode connected to the emission part, a first initialization controlling transistor including a gate electrode to which an initialization signal is applied, a first electrode to which the initialization voltage is applied, and a second electrode connected to the second electrode of the second emission controlling transistor, and a second initialization controlling transistor including a gate electrode to which a data initialization signal is applied, a first electrode to which a data initialization voltage is applied, and a second electrode connected to the gate electrode of the driving transistor.

In example embodiments, the data applying transistor may be configured to apply the data signal to the first electrode of the driving transistor when the scan signal is activated. The threshold voltage compensation transistor may be configured to connect the gate electrode of the driving transistor and the second electrode of the driving transistor when the scan signal is activated, and to apply a compensated data voltage that is a voltage of the data signal compensated based on the threshold voltage of the driving transistor to the storage capacitor. The storage capacitor may be configured to store the compensated data voltage. The driving transistor may be configured to generate the driving current based on the compensated data voltage. The first emission controlling transistor and the second emission controlling transistor may be configured to provide the generated driving current to the emission part based on the emission signal. The first initialization controlling transistor may be configured to initialize the second electrode of the second emission controlling transistor with the initialization voltage based on the initialization signal. The second initialization controlling transistor may be configured to initialize the gate electrode of the driving transistor with a data initialization voltage based on the data initialization signal.

In example embodiments, the initialization signal may be substantially the same as the data initialization signal.

In example embodiments, the initialization voltage may be substantially the same as the data initialization voltage Another aspect is an OLED display may include a display panel including a repair pixel and an active pixel, a power unit configured to provide an aging voltage and an initialization voltage to the active pixel and the repair pixel, a scan driving unit configured to provide a scan signal to the active pixel and the repair pixel, a data driving unit configured to provide a data signal to the active pixel and the repair pixel when the scan signal is activated, and a timing control unit configured to control the scan driving unit and the data driving unit. The active pixel may include an emission part configured to emit light based on a driving current and a driving current providing part configured to provide the driving current to the emission part based on the data signal. The repair pixel may include a repair driving current providing part configured to provide the driving current to the emission part instead of the driving current providing part when the driving current providing part is disconnected from the emission part, and an aging switch connecting the repair driving current providing part to the power unit while an aging operation for the active pixel and the repair pixel is performed, and disconnecting the repair driving current providing part from the power unit after the aging operation is performed.

In example embodiments, the emission part may include an OLED including a first electrode and a second electrode to which a first power voltage is applied and a capacitor connected between the first electrode and the second electrode of the OLED.

In example embodiments, a structure of the repair driving current providing part may be substantially the same as a structure of the driving current providing part.

In example embodiments, the aging voltage may be applied to the driving current providing part and the repair driving current providing part while the aging operation is performed.

In example embodiments, the aging voltage may be applied to a first transistor included in the driving current providing part and a second transistor included in the repair driving current providing part.

In example embodiments, each of the driving current providing part and the repair driving current providing part may include a driving transistor including a gate electrode, a first electrode to which a second power voltage is applied, and a second electrode, a data applying transistor including a gate electrode to which the scan signal is applied, a first electrode to which the data signal is applied, and a second electrode connected to the gate electrode of the driving transistor, a storage capacitor including a first electrode to which the second power voltage is applied and a second electrode connected to the gate electrode of the driving transistor, an emission controlling transistor including a gate electrode to which an emission signal is applied, a first electrode connected to the second electrode of the driving transistor, and a second electrode connected to the emission part, and an initialization controlling transistor including a gate electrode to which an initialization signal is applied, a first electrode to which the initialization voltage is applied, and a second electrode connected to the second electrode of the emission controlling transistor.

In example embodiments, the data applying transistor may be configured to apply the data signal to the storage capacitor when the scan signal is activated. The storage capacitor may be configured to store the applied data signal. The driving transistor may be configured to generate the driving current based on the stored data signal. The emission controlling transistor may be configured to provide the generated driving current to the emission part based on the emission signal. The initialization controlling transistor may be configured to initialize the second electrode of the emission controlling transistor based on the initialization signal.

In example embodiments, each of the driving current providing part and the repair driving current providing part may include a driving transistor including a gate electrode, a first electrode, and a second electrode, a data applying transistor including a gate electrode to which the scan signal is applied, a first electrode to which the data signal is applied, and a second electrode connected to the first electrode of the driving transistor, a threshold voltage compensation transistor including a gate electrode to which the scan signal is applied, a first electrode connected to the second electrode of the driving transistor, and a second electrode connected to the gate electrode of the driving transistor, a storage capacitor including a first electrode to which a second power voltage is applied and a second electrode connected to the gate electrode of the driving transistor, an emission controlling transistor including a gate electrode to which the emission signal is applied, a first electrode connected to the second electrode of the driving transistor, and a second electrode connected to the emission part, a first initialization controlling transistor including a gate electrode to which an initialization signal is applied, a first electrode to which the initialization voltage is applied, and a second electrode connected to the second electrode of the emission control transistor, and a second initialization controlling transistor including a gate electrode to which a data initialization signal is applied, a first electrode to which a data initialization voltage is applied, and a second electrode connected to the gate electrode of the driving transistor.

In example embodiments, the data applying transistor may be configured to apply the data signal to the first electrode of the driving transistor when the scan signal is activated. The threshold voltage compensation transistor may be configured to connect the gate electrode of the driving transistor and the second electrode of the driving transistor when the scan signal is activated, and to apply a compensated data voltage that is a voltage of the data signal compensated based on the threshold voltage of the driving transistor to the storage capacitor. The storage capacitor may be configured to store the compensated data voltage. The data applying transistor may be configured to apply the data signal to the first electrode of the driving transistor when the scan signal is activated. The threshold voltage compensation transistor may be configured to connect the gate electrode of the driving transistor and the second electrode of the driving transistor when the scan signal is activated, and to apply a compensated data voltage that is a voltage of the data signal compensated based on the threshold voltage of the driving transistor to the storage capacitor. The storage capacitor may be configured to store the compensated data voltage. The driving transistor may be configured to generate the driving current based on the compensated data voltage. The emission controlling transistor may be configured to provide the generated driving current to the emission part based on the emission signal. The first initialization controlling transistor may be configured to initialize the second electrode of the emission controlling transistor based on the initialization signal. The second initialization controlling transistor may be configured to initialize the gate electrode of the driving transistor based on the data initialization signal.

Another aspect is a display panel comprising an active pixel including: i) a driving circuit configured to generate a driving current based on a data signal and ii) an emission circuit configured to emit light based on the driving current; and a repair pixel comprising: a repair driving circuit configured to provide a repair driving current to the emission circuit instead of the driving current of the driving circuit when the driving circuit is disconnected from the emission circuit; and an aging switch electrically connected to a power supply that is configured to generate an aging voltage, wherein the aging switch is configured to: i) apply the aging voltage to the repair driving circuit during an aging operation for the active pixel and the repair pixel and ii) electrically disconnect the repair driving circuit from the power supply after the aging operation is performed.

In example embodiments, the emission circuit includes an OLED including a first electrode and a second electrode configured to receive a first power voltage; and a capacitor connected between the first electrode and the second electrode of the OLED. The structure of the repair driving circuit can be substantially the same as the structure of the driving circuit. The driving circuit and the repair driving circuit can each be configured to receive the aging voltage during the aging operation. A first transistor included in the driving circuit and a second transistor included in the repair driving circuit can each be configured to receive the aging voltage.

In example embodiments, each of the driving circuit and the repair driving circuit includes a driving transistor including a gate electrode, a first electrode configured to receive a second power voltage, and a second electrode; a data switching transistor including a gate electrode configured to receive a scan signal, a first electrode configured to receive the data signal, and a second electrode connected to the gate electrode of the driving transistor; a storage capacitor including a first electrode configured to receive the second power voltage and a second electrode connected to the gate electrode of the driving transistor; an emission control transistor including a gate electrode configured to receive an emission signal, a first electrode connected to the second electrode of the driving transistor, and a second electrode connected to the emission circuit; and an initialization control transistor including a gate electrode configured to receive an initialization signal, a first electrode configured to receive an initialization voltage, and a second electrode connected to the second electrode of the emission control transistor.

In example embodiments, the data switching transistor is configured to apply the data signal to the storage capacitor when the scan signal is activated, the storage capacitor is configured to store the data signal, the driving transistor is configured to generate the driving current based on the stored data signal, the emission control transistor is configured to provide the generated driving current to the emission circuit based on the emission signal, and the initialization control transistor is configured to initialize the second electrode of the emission control transistor to the initialization voltage based on the initialization signal.

In example embodiments, each of the driving circuit and the repair driving circuit includes a driving transistor including a gate electrode, a first electrode, and a second electrode; a data switching transistor including a gate electrode configured to receive a scan signal, a first electrode configured to receive the data signal, and a second electrode connected to the first electrode of the driving transistor; a threshold voltage compensation transistor including a gate electrode configured to receive the scan signal, a first electrode connected to the second electrode of the driving transistor, and a second electrode connected to the gate electrode of the driving transistor; a storage capacitor including a first electrode configured to receive a second power voltage and a second electrode connected to the gate electrode of the driving transistor; a first emission control transistor including a gate electrode configured to receive an emission signal, a first electrode configured to receive the second power voltage, and a second electrode connected to the first electrode of the driving transistor; a second emission control transistor including a gate electrode configured to receive the emission signal, a first electrode connected to the second electrode of the driving transistor, and a second electrode connected to the emission circuit; a first initialization control transistor including a gate electrode configured to receive an initialization signal, a first electrode configured to receive the initialization voltage, and a second electrode connected to the second electrode of the second emission control transistor; and a second initialization control transistor including a gate electrode configured to receive a data initialization signal, a first electrode configured to receive a data initialization voltage, and a second electrode connected to the gate electrode of the driving transistor.

In example embodiments, the data switching transistor is configured to apply the data signal to the first electrode of the driving transistor when the scan signal is activated, the threshold voltage compensation transistor is configured to connect the gate electrode of the driving transistor to the second electrode of the driving transistor when the scan signal is activated, the threshold voltage compensation transistor is further configured to i) compensate the data signal based on the threshold voltage of the driving transistor so as to generate a compensated data voltage and ii) apply the compensated data voltage to the storage capacitor, the storage capacitor is configured to store the compensated data voltage, the driving transistor is configured to generate the driving current based on the compensated data voltage, the first and second emission control transistors are configured to provide the generated driving current to the emission circuit based on the emission signal, the first initialization control transistor is configured to initialize the second electrode of the second emission control transistor to the initialization voltage based on the initialization signal, and the second initialization control transistor is configured to initialize the gate electrode of the driving transistor to a data initialization voltage based on the data initialization signal.

In example embodiments, the initialization signal is substantially the same as the data initialization signal. The initialization voltage can be substantially the same as the data initialization voltage.

Another aspect is an OLED display comprising a display panel including a repair pixel and an active pixel; a power supply configured to apply an aging voltage and an initialization voltage to each of the active pixel and the repair pixel; a scan driver configured to provide a scan signal to each of the active pixel and the repair pixel; a data driver configured to provide a data signal to each of the active pixel and the repair pixel when the scan signal is activated; and a timing controller configured to control the scan driver and the data driver, wherein the active pixel includes: an emission circuit configured to emit light based on a driving current; and a driving circuit configured to provide the driving current to the emission circuit based on the data signal, and wherein the repair pixel includes: a repair driving circuit configured to provide a repair driving current to the emission circuit instead of the driving current of the driving current circuit when the driving current circuit is disconnected from the emission circuit; and an aging switch electrically connected to the power supply and configured to: i) apply the aging voltage to the repair driving circuit during an aging operation for the active pixel and the repair pixel and ii) electrically disconnect the repair driving circuit from the power supply after the aging operation is performed.

In example embodiments, the emission circuit includes an OLED including a first electrode and a second electrode configured to receive a first power voltage; and a capacitor connected between the first electrode and the second electrode of the OLED. The structure of the repair driving circuit can be substantially the same as the structure of the driving circuit. The power supply can be further configured to apply the aging voltage to the driving circuit and the repair driving circuit during the aging operation. The power supply can be further configured to apply the aging voltage to a first transistor included in the driving circuit and a second transistor included in the repair driving circuit.

In example embodiments, each of the driving circuit and the repair driving circuit includes a driving transistor including a gate electrode, a first electrode configured to receive a second power voltage, and a second electrode; a data switching transistor including a gate electrode configured to receive the scan signal, a first electrode configured to receive the data signal, and a second electrode connected to the gate electrode of the driving transistor; a storage capacitor including a first electrode configured to receive the second power voltage and a second electrode connected to the gate electrode of the driving transistor; an emission control transistor including a gate electrode configured to receive an emission signal, a first electrode connected to the second electrode of the driving transistor, and a second electrode connected to the emission circuit; and an initialization control transistor including a gate electrode configured to receive an initialization signal, a first electrode configured to receive an initialization voltage, and a second electrode connected to the second electrode of the emission control transistor.

In example embodiments, the data switching transistor is configured to apply the data signal to the storage capacitor when the scan signal is activated, the storage capacitor is configured to store the data signal, the driving transistor is configured to generate the driving current based on the stored data signal, the emission control transistor is configured to provide the generated driving current to the emission circuit based on the emission signal, and the initialization control transistor is configured to initialize the second electrode of the emission control transistor based on the initialization signal.

In example embodiments, each of the driving circuit and the repair driving circuit includes a driving transistor including a gate electrode, a first electrode, and a second electrode; a data switching transistor including a gate electrode configured to receive the scan signal, a first electrode configured to receive the data signal, and a second electrode connected to the first electrode of the driving transistor; a threshold voltage compensation transistor including a gate electrode configured to receive the scan signal, a first electrode connected to the second electrode of the driving transistor, and a second electrode connected to the gate electrode of the driving transistor; a storage capacitor including a first electrode configured to receive a second power voltage and a second electrode connected to the gate electrode of the driving transistor; an emission control transistor including a gate electrode configured to receive the emission signal, a first electrode connected to the second electrode of the driving transistor, and a second electrode connected to the emission circuit; a first initialization control transistor including a gate electrode configured to receive an initialization signal, a first electrode configured to receive the initialization voltage, and a second electrode connected to the second electrode of the emission control transistor; and a second initialization control transistor including a gate electrode configured to receive a data initialization signal, a first electrode configured to receive a data initialization voltage, and a second electrode connected to the gate electrode of the driving transistor.

In example embodiments, the data switching transistor is configured to apply the data signal to the first electrode of the driving transistor when the scan signal is activated, the threshold voltage compensation transistor is configured to connect the gate electrode of the driving transistor to the second electrode of the driving transistor when the scan signal is activated, the threshold voltage compensation transistor is further configured to i) compensate the data signal based on the threshold voltage of the driving transistor so as to generate a compensated data voltage and ii) apply the compensated data voltage to the storage capacitor, the storage capacitor is configured to store the compensated data voltage, the driving transistor is configured to generate the driving current based on the compensated data voltage, the emission control transistor is configured to provide the generated driving current to the emission circuit based on the emission signal, the first initialization control transistor is configured to initialize the second electrode of the emission control transistor based on the initialization signal, and the second initialization control transistor is configured to initialize the gate electrode of the driving transistor based on the data initialization signal.

A repair driving current providing unit performs an aging operation and generates the driving current instead of the damaged driving current providing part without an initial operation using an initial voltage. Therefore, a display panel and an OLED display according to at least one embodiment can provide a driving current to an OLED when the driving current providing part is damaged, can reduce effects of a capacitance of a parasitic capacitor generated in a current providing line, and can uniformly generate the driving current using transistors of which the leakage current is reduced.

BRIEF DESCRIPTION OF THE DRAWINGS

Illustrative, non-limiting example embodiments will be more clearly understood from the following detailed description taken in conjunction with the accompanying drawings.

DETAILED DESCRIPTION OF CERTAIN INVENTIVE EMBODIMENTS

A driving circuit is connected to an OLED via a current providing line. As the length of the current providing line increases, the capacitance of a parasitic capacitor formed between the current providing line and peripheral elements increases. Accordingly, when the voltages of the peripheral elements change, the voltage of the current providing line has a corresponding change due to the change in charge stored in the parasitic capacitor.

In addition, the performance characteristics of transistors can diverge from each other. An aging operation can be performed on the transistors over time in which a predetermined voltage is applied to the transistors to reduce leakage current and improve the uniformity of the transistors.

Exemplary embodiments will be described more fully hereinafter with reference to the accompanying drawings, in which various embodiments are shown.

Illustrative, non-limiting example embodiments will be more clearly understood from the following detailed description taken in conjunction with the accompanying drawings.

Figure 1:
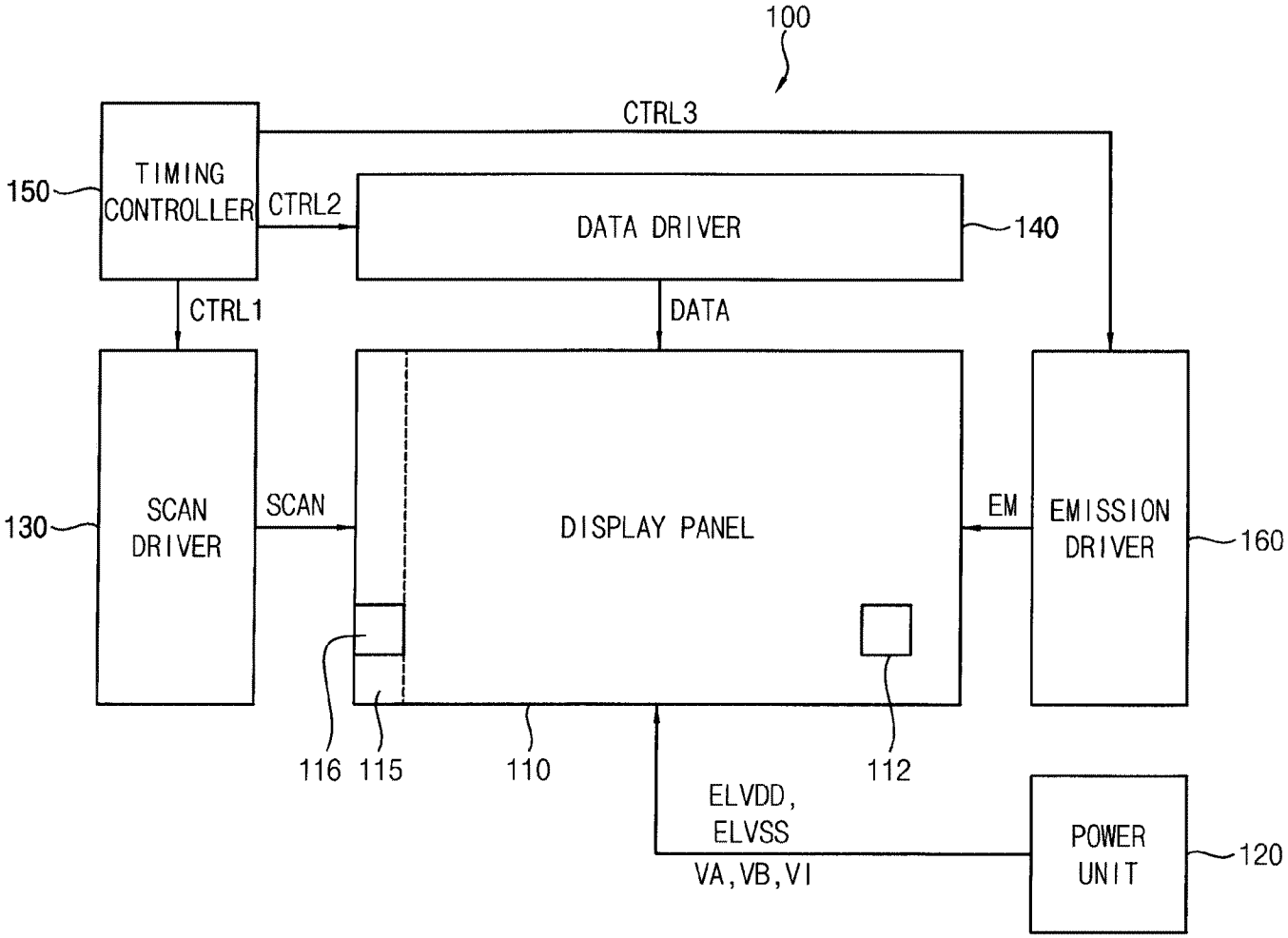
FIG. 1 is a block diagram illustrating an OLED display according to example embodiments.

FIG. 1 is a block diagram illustrating an OLED display according to example embodiments.

Referring to FIG. 1, an OLED display 100 includes a display panel 110, a power unit or power supply 120, a scan driving unit or scan driver 130, a data driving unit or data driver 140, and a timing control unit or timing controller 150. In one example embodiment, the OLED display 100 further includes an emission driving unit or emission driver 160.

The display panel 110 includes a repair pixel 116 and an active pixel 112. In one example embodiment, the repair pixel 116 is located on at least one edge 115 of the display panel 110. The active pixel 112 includes an emission part or emission circuit and a driving current providing part or driving circuit. The repair pixel 116 includes a repair driving current providing part or repair driving circuit and an aging switch. The emission part can emit light based on a driving current. The driving current providing part can provide the driving current to the emission part based on a data signal DATA. The repair driving current providing part can provide the driving current to the emission part instead of the driving current providing part when the driving current providing part is disconnected from the emission part. The aging switch can connect the repair driving current providing part to the power unit 120 that provides an aging voltage VA when an aging operation for the active pixel 112 and the repair pixel 116 is performed. The aging switch can disconnect the repair driving current providing part from the power unit 120 that provides an initialization voltage VB after the aging operation is performed. Hereinafter, operations of the display panel 110 will be described in detail with reference to FIG. 2 and FIG. 3.

The power unit 120 provides a first power voltage ELVSS, a second power voltage ELVDD, the aging voltage VA, and the initialization voltage VB to the active pixel 112 and the repair pixel 116. In one example embodiment, the power unit 120 further includes a data initialization voltage VI that is provided to the active pixel 112 and the repair pixel 116.

The scan driving unit 130 provides a scan signal SCAN to the active pixel 112 and the repair pixel 116. The data driving unit 140 provides the data signal DATA to the active pixel 112 and the repair pixel 116 when the scan signal SCAN is activated.

The timing control unit 150 controls the scan driving unit 130 and the data driving unit 140. The timing control unit 150 controls the scan driving unit 130 based on a first control signal CTRL1, the data driving unit 140 based on a second control signal CTRL2, and the emission driving unit 160 based on a third control signal CTRL3.

The emission driving unit 160 provides an emission signal EM to the active pixel 112 and the repair pixel 116. Emission operations of the active pixel 112 and the repair pixel 116 can be controlled by the emission signal EM.

Figure 2:
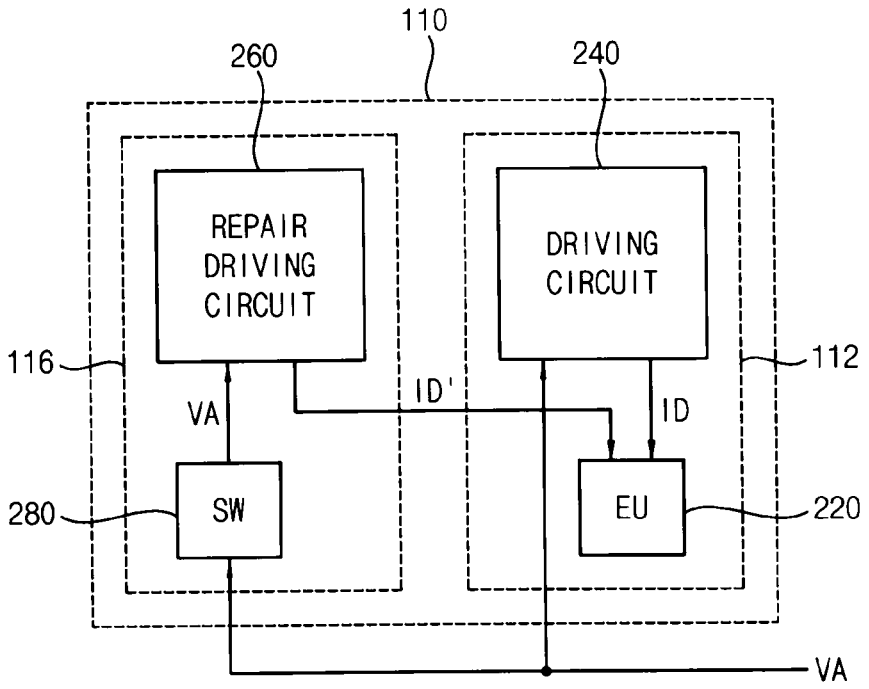
FIG. 2 is a block diagram illustrating an example of a display panel included in the OLED display of FIG. 1 while an aging operation is performed.

FIG. 2 is a block diagram illustrating an example of a display panel included in an OLED display of FIG. 1 while an aging operation is performed.

Referring to FIG. 2, a display panel 110 includes an active pixel 112 and a repair pixel 116. The active pixel 112 includes an emission part 220 and a driving current providing part or driving circuit 240. The repair pixel 116 includes a repair driving current providing part or repair driving circuit 260 and an aging switch 280.

The aging switch 280 connects the repair driving current providing part 260 to a power unit that provides an aging voltage VA while an aging operation for the active pixel 112 and the repair pixel 116 is performed. In one example embodiment, the aging voltage VA is applied to the driving current providing part 240 and the repair driving current providing part 260 while the aging operation is performed. In one example embodiment, the aging voltage VA is applied to a first transistor included in the driving current providing part 240 and a second transistor included in the repair driving current providing part 260.

In one example embodiment, the structure of the repair driving current providing part 260 is substantially the same as a structure of the driving current providing part 240. Therefore, the magnitude of a repair driving current ID' generated by the repair driving current providing part 260 is substantially the same as the magnitude of an active driving current ID generated by the driving current providing part 240.

In addition, voltages having predetermined voltage levels can be applied to the driving current providing part 240 and the repair driving current providing part 260 instead of a first power voltage ELVSS and a second power voltage ELVDD while the aging operation is performed. Thus, the same voltages are applied to the driving current providing part 240 and the repair driving current providing part 260 during the same time period. Therefore, the characteristics of the transistors included in the driving current providing part 240 may be substantially the same as a characteristic of transistors included in the repair driving current providing part 260. As a result, the magnitude of the repair driving current ID' generated by the repair driving current providing part 260 is substantially the same as that of the active driving current ID generated by the driving current providing part 240.

The driving current providing part 240 and the repair driving current providing part 260 provide the driving currents ID and ID' to the emission part 220 while the aging operation is performed. The voltages having predetermined voltage levels as well as the aging voltage VA are applied to the driving current providing part 240 and the repair driving current providing part 260 instead of a first power voltage ELVSS and a second power voltage ELVDD. As a result, the driving current providing part 240 and the repair driving current providing part 260 provide the driving currents ID and ID' to the emission part 220.

The repair driving current providing part 260 provides the repair driving current ID' to the emission part 220 instead of the driving current providing part 240 when the driving current providing part 240 is disconnected from the emission part 220 (e.g., when the driving current providing part 240 is damaged). The repair driving current providing part 260 also provides the repair driving current ID' to the emission part 220 instead of the driving current providing part 240 when the aging operation is performed. In one example embodiment, when the driving current providing part 240 is damaged, the driving current providing part 240 is disconnected from the emission part 220 and the repair driving current providing part 260 is connected to the emission part 220. Thus, a driving current switching operation is performed. The driving current switching operation disconnects a first current providing line from the driving current providing part 240 and connects a second current providing line, connected to the repair driving current providing part 260, to the emission part 220. In one example embodiment, the driving current switching operation is performed during a dead pixel detection period after the display panel 110 is manufactured. In another example embodiment, the driving current switching operation is performed by measuring the active driving current ID of the driving current providing part 240 while the display panel 110 is operated.

The emission part 220 also emits light based on the active driving current ID provided by the driving current providing part 240 or the repair diving current ID' provided by the repair driving current providing part 260 while the aging operation for the active pixel 112 and the repair pixel 116 is performed. In some embodiments, the emission part 220 includes an OLED. The larger the magnitude of the driving current ID or ID' applied to the OLED, the greater the increase in luminance of the OLED. In one example embodiment, the emission part 220 further includes a capacitor. The capacitor included in the emission part 220 is connected between the first electrode and the second electrode of the OLED.

Figure 3:
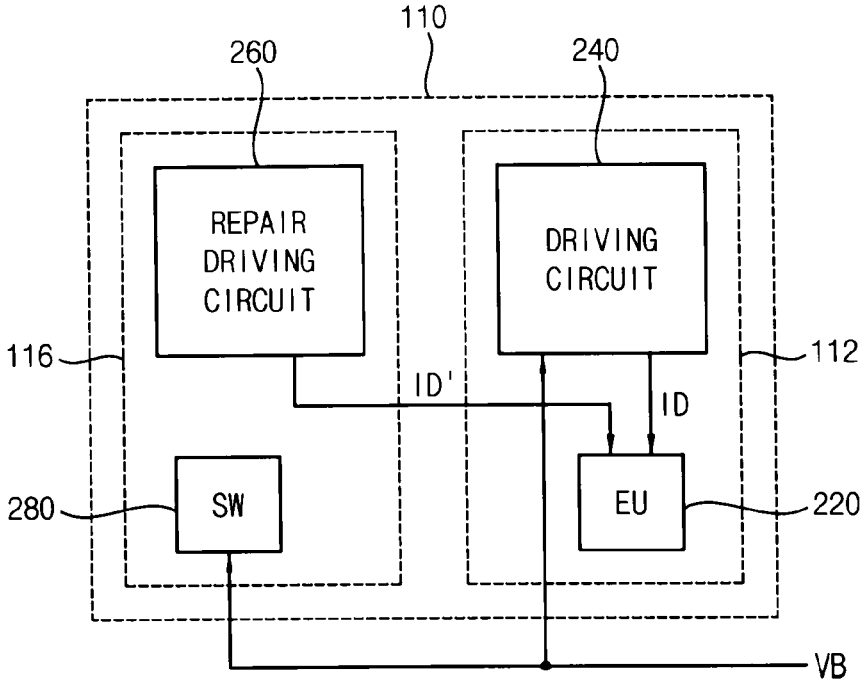
FIG. 3 is a block diagram illustrating an example of a display panel included in the OLED display of FIG. 1 after an aging operation is performed.

FIG. 3 is a block diagram illustrating an example of a display panel included in an OLED display of FIG. 1 after an aging operation is performed.

Referring to FIG. 3, the display panel 110 includes an active pixel 112 and a repair pixel 116. The active pixel 112 includes an emission part 220 and a driving current providing part 240. The repair pixel 116 includes a repair driving current providing part 260 and an aging switch 280.

The aging switch 280 disconnects the repair driving current providing part 260 from the power unit that provides an initialization voltage VB after the aging operation is performed. Thus, the initialization voltage VB is not applied to the repair driving current providing part 260 but is applied the driving current providing part 240.

The emission part 220 also emits light based on the active driving current ID provided by the driving current providing part 240 or the repair diving current ID' provided by the repair driving current providing part 260. In some embodiments, the emission part 220 includes an OLED. The larger the magnitude of the driving current ID or ID' applied to the OLED, the greater the increase luminance of the OLED. In one example embodiment, the emission part 220 further includes a capacitor. The capacitor included in the emission part 220 is connected between the first electrode and the second electrode of the OLED.

When the OLED does not emit the light, the voltage difference between both electrodes of the OLED is less than the threshold voltage of the OLED. Thus, when the voltage difference between both electrodes of the OLED is greater than the threshold voltage of the OLED, the OLED emits light. When the capacitor included in the emission part 220 is charged to a critical value, the voltage difference between both electrodes of the OLED reaches the threshold voltage and the OLED emits light.

When the OLED displays black in one frame, an magnitude of the driving current ID or ID' provided by the driving current providing part 240 or the repair driving current providing part 260 is substantially zero. However, a leakage current may be generated from the driving current providing part 240 or the repair driving current providing part 260. The leakage current may flow through the capacitor instead of the OLED, thereby preventing emission of the OLED while the capacitor is charged to the critical value by the leakage current. Therefore, the magnitude of the initialization charge and the size of the capacitor may be adjusted according to a time period over which the OLED is prevented from emitting light.

The driving current providing part 240 provides the active driving current ID to the emission part 220. An analog driving technique adjusts the magnitude of the active driving current ID provided by the driving current providing part 240, thereby displaying a grayscale corresponding to the data signal provided to the active pixel 112. A digital driving technique adjusts the time period that the active driving current ID is provided for, thereby displaying the grayscale corresponding to the data signal provided to the active pixel 112.

In one example embodiment, the initialization voltage VB is applied to the driving current providing part 240 for an initial period of every frame. The magnitude of initialization charge can be adjusted by the initialization voltage VB.

The repair driving current providing part 260 provides the repair driving current ID' to the emission part 220 instead of the driving current providing part 240 when the driving current providing part 240 is damaged. In one example embodiment, when the driving current providing part 240 is damaged, the driving current providing part 240 is disconnected from the emission part 220 and the repair driving current providing part 260 is connected to the emission part 220. Thus, a driving current switching operation may be performed. The driving current switching operation disconnects an active current providing line from the driving current providing part 240 and connects a repair current providing line, connected to the repair driving current providing part 260, to the emission part 220. In one example embodiment, the driving current switching operation is performed during a dead pixel detecting period after the display panel 110 is manufactured. In another example embodiment, the driving current switching operation is performed by measuring the active driving current ID of the driving current providing part 240 while the display panel 110 is operated.

In one example embodiment, the structure of the repair driving current providing part 260 is substantially the same as the structure of the driving current providing part 240. Therefore, the magnitude of the repair driving current ID' generated by the repair driving current providing part 260 is substantially the same as the magnitude of the active driving current ID generated by the driving current providing part 240.

The initialization voltage VB is not applied to the repair driving current providing part 260. Therefore, the capacitor included in the repair driving current providing part 260 is not initialized by the initialization voltage VB. The capacitance of a parasitic capacitor generated between the repair current providing line through which the repair driving current ID' is flowed and peripheral elements may be sufficiently large. Therefore, voltage variation of the repair current providing line generated by the leakage current of the repair driving current providing part 260 can be ignored.

The voltage of the repair current providing line can be affected by the parasitic capacitor. For example, the voltage of the repair current providing line can be boosted by the parasitic capacitor. Because the repair current providing line is connect to one electrode of the OLED, the OLED may emit light with an unnecessarily high luminance. However, because the initialization voltage VB is not applied to the repair driving current providing part 260, the boosted voltage of the repair current providing line can be self-canceling. The self-canceling operation will be described in detail with reference to FIG. 8 and FIG. 9.

Figure 4:
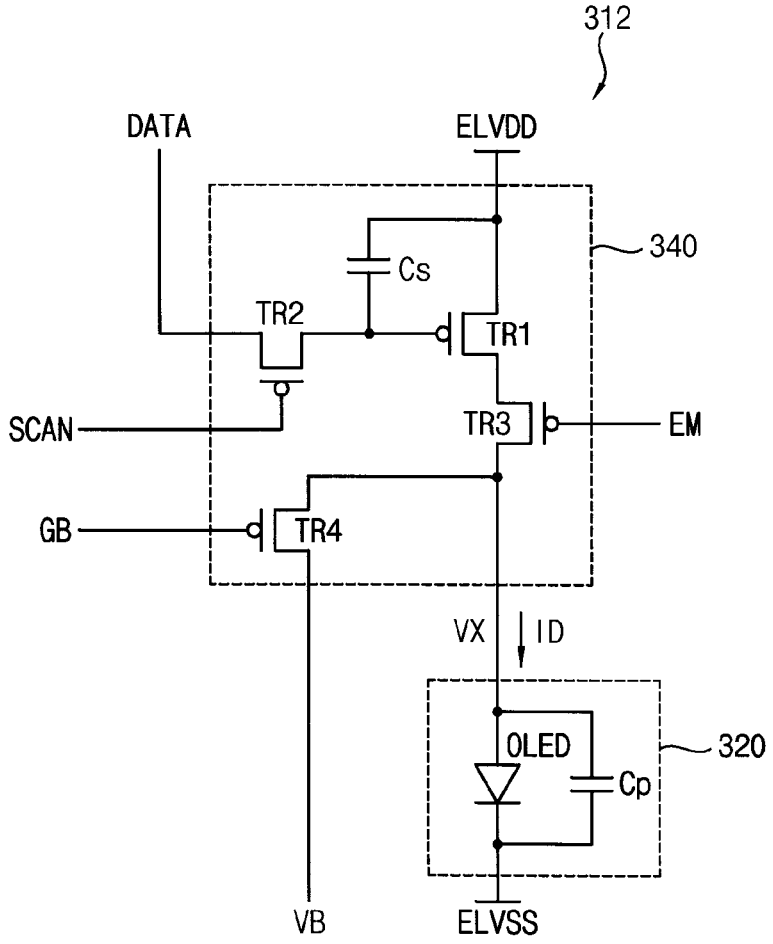
FIG. 4 is a circuit diagram illustrating one example of an active pixel.

FIG. 4 is a circuit diagram illustrating one example of an active pixel.

Referring to FIG. 4, an active pixel 312 includes an emission part 320 and a driving current providing part 340. The emission part 320 includes an OLED and a capacitor Cp. The driving current providing part 340 includes a driving transistor TR1, a data applying transistor or data switching transistor TR2, a storage capacitor Cs, an emission controlling transistor or emission control transistor TR3, and an initialization controlling transistor or initialization control transistor TR4.

The OLED includes a first electrode and a second electrode to which a first power voltage ELVSS is applied. The OLED emits light based on a driving current ID. The capacitor Cp is connected between the first electrode and the second electrode of the OLED. In one example embodiment, the capacitor Cp is a parasitic capacitor generated between the first electrode and the second electrode of the OLED.

The data applying transistor TR2 includes a gate electrode to which a scan signal SCAN is applied, a first electrode to which a data signal DATA is applied, and a second electrode connected to the gate electrode of the driving transistor TR1. The data applying transistor TR2 applies the data signal DATA to the storage capacitor Cs when the scan signal SCAN is activated.

The storage capacitor Cs includes a first electrode to which the second power voltage ELVDD is applied and a second electrode connected to the gate electrode of the driving transistor TR1. The storage capacitor Cs stores the data signal DATA for a certain period of time.

The driving transistor TR1 includes a gate electrode, a first electrode to which the second power voltage ELVDD is applied, and a second electrode. The driving transistor TR1 generates the driving current ID based on the stored data signal DATA.

The emission controlling transistor TR3 includes a gate electrode to which an emission signal EM is applied, a first electrode connected to the second electrode of the driving transistor TR1, and a second electrode connected to the emission part 320. The emission controlling transistor TR3 provides the generated driving current ID to the emission part 320 based on the emission signal EM.

The initialization controlling transistor TR4 includes a gate electrode to which an initialization signal GB is applied, a first electrode to which the initialization voltage VB is applied, and a second electrode connected to the second electrode of the emission controlling transistor TR3. The initialization controlling transistor TR4 initializes the second electrode of the emission controlling transistor TR4 (i.e., the first current providing line voltage VX) with the initialization voltage VB based on the initialization signal GB.

The aging voltage VA of FIG. 2 is applied to the emission part 320 and driving current providing part 340 instead of the initialization voltage VB when the aging operation is performed. Also, voltages having predetermined voltage levels are applied to the emission part 320 and driving current providing part 340 instead of the first power voltage ELVSS and the second power voltage ELVDD when the aging operation is performed. Therefore, the characteristics of transistors TR1 through TR4 included in the driving current providing part 340 can be improved.

Figure 5:
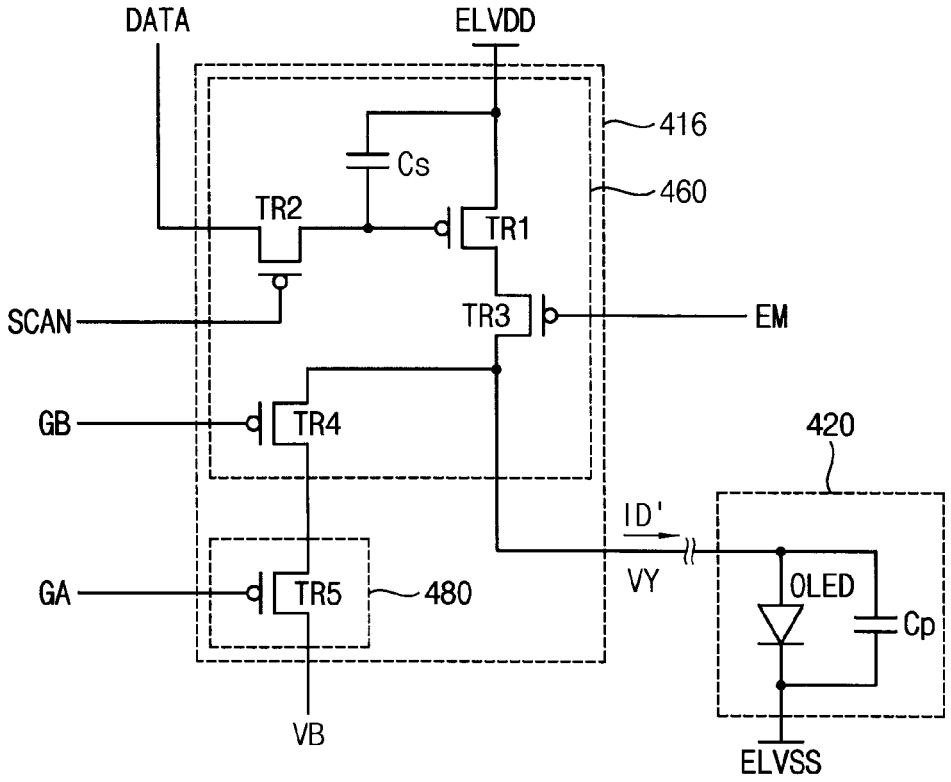
FIG. 5 is a circuit diagram illustrating one example of a repair pixel.

FIG. 5 is a circuit diagram illustrating one example of a repair pixel.

Referring to FIG. 5, a driving current providing part of FIG. 4 may be deactivated. A repair driving current providing part 460 provides a driving current ID' to the emission part 420 instead of the driving current providing part. A repair pixel 416 includes a repair driving current providing part 460 and an aging switch 480. The emission part 420 includes an OLED and a capacitor Cp. In one example embodiment, the structure of the repair driving current providing part 460 is substantially the same as the structure of the driving current providing part. The repair driving current providing part 460 includes a driving transistor TR1, a data applying transistor TR2, a storage capacitor Cs, an emission controlling transistor TR3, and an initialization controlling transistor TR4. The aging switch 480 includes a switching transistor TR5.

The OLED includes a first electrode and a second electrode to which a first power voltage ELVSS is applied. The OLED emits light based on the driving current ID'. The capacitor Cp is connected between the first electrode and the second electrode of the OLED. In one example embodiment, the capacitor Cp is a parasitic capacitor generated between the first electrode and the second electrode of the OLED.

The data applying transistor TR2 includes a gate electrode to which a scan signal SCAN is applied, a first electrode to which a data signal DATA is applied, and a second electrode connected to the gate electrode of the driving transistor TR1. The data applying transistor TR2 applies the data signal DATA to the storage capacitor Cs when the scan signal SCAN is activated.

The storage capacitor Cs includes a first electrode to which the second power voltage ELVDD is applied and a second electrode connected to the gate electrode of the driving transistor TR1. The storage capacitor Cs stores the data signal DATA for a certain period of time.

The driving transistor TR1 includes a gate electrode, a first electrode to which the second power voltage ELVDD is applied, and a second electrode. The driving transistor TR1 generates the driving current ID' based on the stored data signal DATA.

The emission controlling transistor TR3 includes a gate electrode to which an emission signal EM is applied, a first electrode connected to the second electrode of the driving transistor TR1, and a second electrode connected to the emission part 420. The emission controlling transistor TR3 provides the generated driving current ID' to the emission part 420 based on the emission signal EM.

The switching transistor TR5 includes a gate electrode to which the aging signal GA is applied, a first electrode connected to the repair driving current providing part 460, and a second electrode to which the initialization voltage VB is applied. The aging signal GA is activated when the aging operation is performed. The aging signal GA is deactivated after the aging operation is complete. Thus, after the aging operation is complete, the switching transistor TR5 is turned off to prevent the initialization voltage VB from being applied to the repair driving current providing part 460.

The initialization controlling transistor TR4 includes a gate electrode to which an initialization signal GB is applied, a first electrode connected to the aging switch 480, and a second electrode connected to the second electrode of the emission controlling transistor T3. In comparison with the driving current providing part of FIG. 4, the repair driving current providing part 460 is connected to the aging switch 480. The aging switch 480 can be turned off to prevent the initialization voltage VB from being applied after the aging operation is performed. Therefore, the initialization controlling transistor TR4 does not initialize a second current providing line voltage VY or a voltage of the second electrode of the emission controlling transistor TR3 with the initialization voltage VB based on the initialization signal GB.

The aging voltage VA of FIG. 2 can be applied instead of the initialization voltage VB while the aging operation is performed. Also, voltages having predetermined voltage levels can be applied to the emission part 420 and the repair driving current providing part 460 instead of the first power voltage ELVSS and the second power voltage ELVDD while the aging operation is performed. In addition, transistors TR1 through TR4 included in the repair driving current providing part 460 operate the same as transistors included in the driving current providing part of FIG. 4 while the aging operation is performed, such that the transistors have substantially uniform characteristics.

Figure 6:
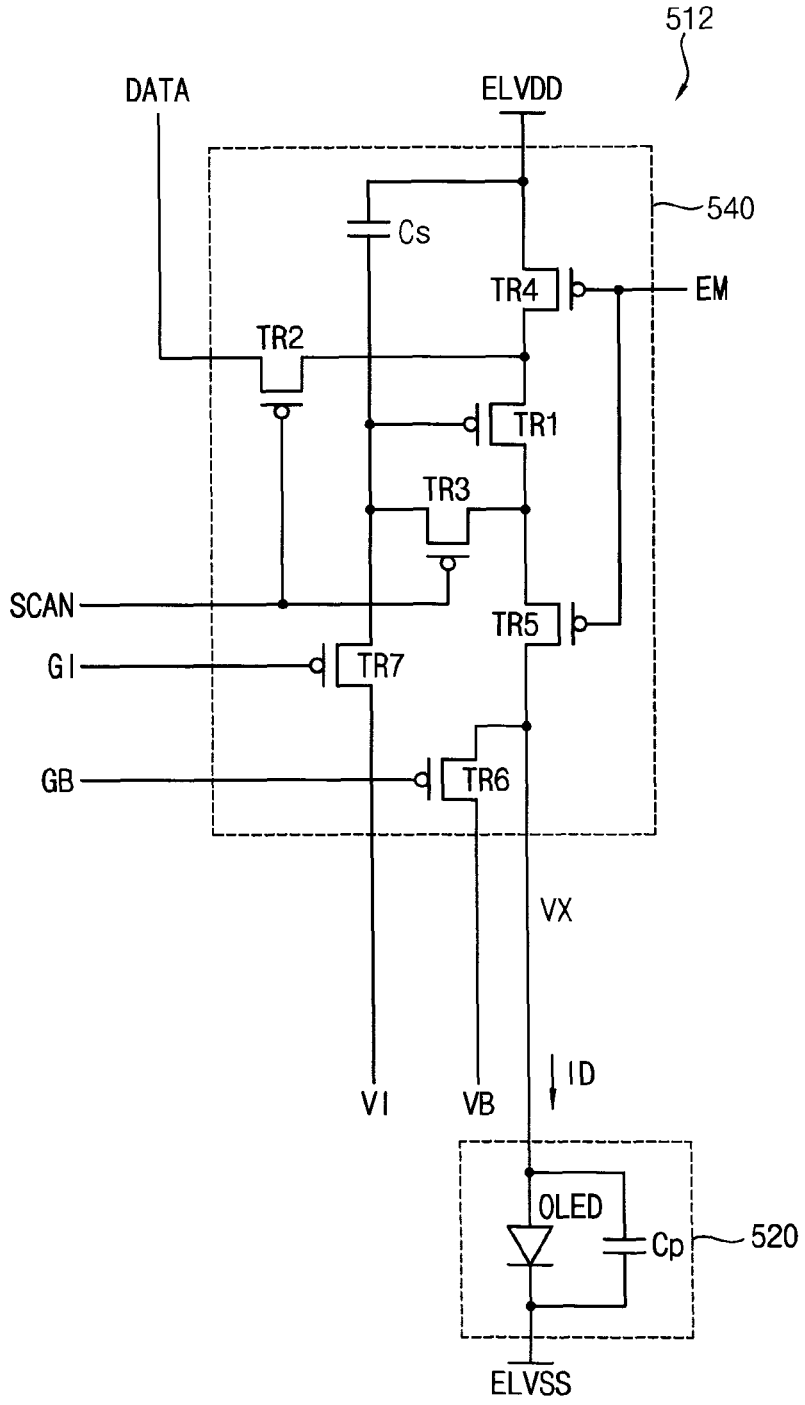
FIG. 6 is a circuit diagram illustrating another example of an active pixel.

FIG. 6 is a circuit diagram illustrating another example of an active pixel.

Referring to FIG. 6, an active pixel 512 includes an emission part 520 and a driving current providing part 540. The emission part 520 includes an OLED and a capacitor Cp. The driving current providing part 540 includes a driving transistor TR1, a data applying transistor TR2, a threshold voltage compensation transistor TR3, a storage capacitor Cs, a first emission controlling transistor TR4, a second emission controlling transistor TR5, a first initialization controlling transistor TR6 and a second initialization controlling transistor TR7.

The OLED includes a first electrode and a second electrode to which a first power voltage ELVSS is applied. The OLED emits light based on a driving current ID. The capacitor Cp is connected between the first electrode and the second electrode of the OLED. In one example embodiment, the capacitor Cp is a parasitic capacitor generated between the first electrode and the second electrode of the OLED.

The data applying transistor TR2 includes a gate electrode to which a scan signal SCAN is applied, a first electrode to which a data signal DATA is applied, and a second electrode connected to the first electrode of the driving transistor TR1. The data applying transistor TR2 applies the data signal DATA to the first electrode of the driving transistor TR1 when the scan signal SCAN is activated.

The threshold voltage compensation transistor TR3 includes a gate electrode to which the scan signal SCAN is applied, a first electrode connected to the second electrode of the driving transistor TR1, and a second electrode connected to the gate electrode of the driving transistor TR1. The threshold voltage compensation transistor TR3 connects the gate electrode of the driving transistor TR1 and the second electrode of the driving transistor TR1 when the scan signal is activated. The threshold voltage compensation transistor TR3 applies a compensated data voltage that is a voltage of the data signal DATA compensated based on the threshold voltage of the driving transistor TR1 to the storage capacitor Cs.

The storage capacitor Cs includes a first electrode to which the second power voltage ELVDD is applied and a second electrode connected to the gate electrode of the driving transistor TR1. The storage capacitor Cs stores the compensated data voltage for a certain period of time.

The driving transistor TR1 includes a gate electrode, a first electrode, and a second electrode. The driving transistor TR1 generates the driving current ID based on the compensated data voltage.

The first emission controlling transistor TR4 includes a gate electrode to which an emission signal EM is applied, a first electrode to which the second power voltage ELVDD is applied, and a second electrode connected to the first electrode of the driving transistor TR1. The second emission controlling transistor TR5 includes a gate electrode to which the emission signal EM is applied, a first electrode connected to the second electrode of the driving transistor TR1, and a second electrode connected to the emission part 520. The first emission controlling transistor TR4 and the second emission controlling transistor TR5 provide the driving current ID generated in the driving transistor TR1 to the emission part 520 based on the emission signal EM.

The first initialization controlling transistor TR6 includes a gate electrode to which an initialization signal GB is applied, a first electrode to which the initialization voltage VB is applied, and a second electrode connected to the second electrode of the second emission controlling transistor TR5. The first initialization controlling transistor TR6 initializes a first current providing line voltage VX or a voltage of the second electrode of the second emission controlling transistor TR5 with the initialization voltage VB based on the initialization signal GB.

The second initialization controlling transistor TR7 includes a gate electrode to which a data initialization signal GI is applied, a first electrode to which a data initialization voltage VI is applied, and a second electrode connected to the gate electrode of the driving transistor TR1. The second initialization controlling transistor TR7 initializes the gate electrode of the driving transistor TR1 with a data initialization voltage VI based on the data initialization signal GI.

The aging voltage VA of FIG. 2 is applied instead of the initialization voltage VB when the aging operation is performed. Also, voltages having predetermined voltage levels are applied to the emission part 520 and the driving current providing part 540 instead of the first power voltage ELVSS and the second power voltage ELVDD when the aging operation is performed. Therefore, the characteristics of transistors TR1 through TR7 included in the driving current providing part 540 can be improved.

Figure 7:
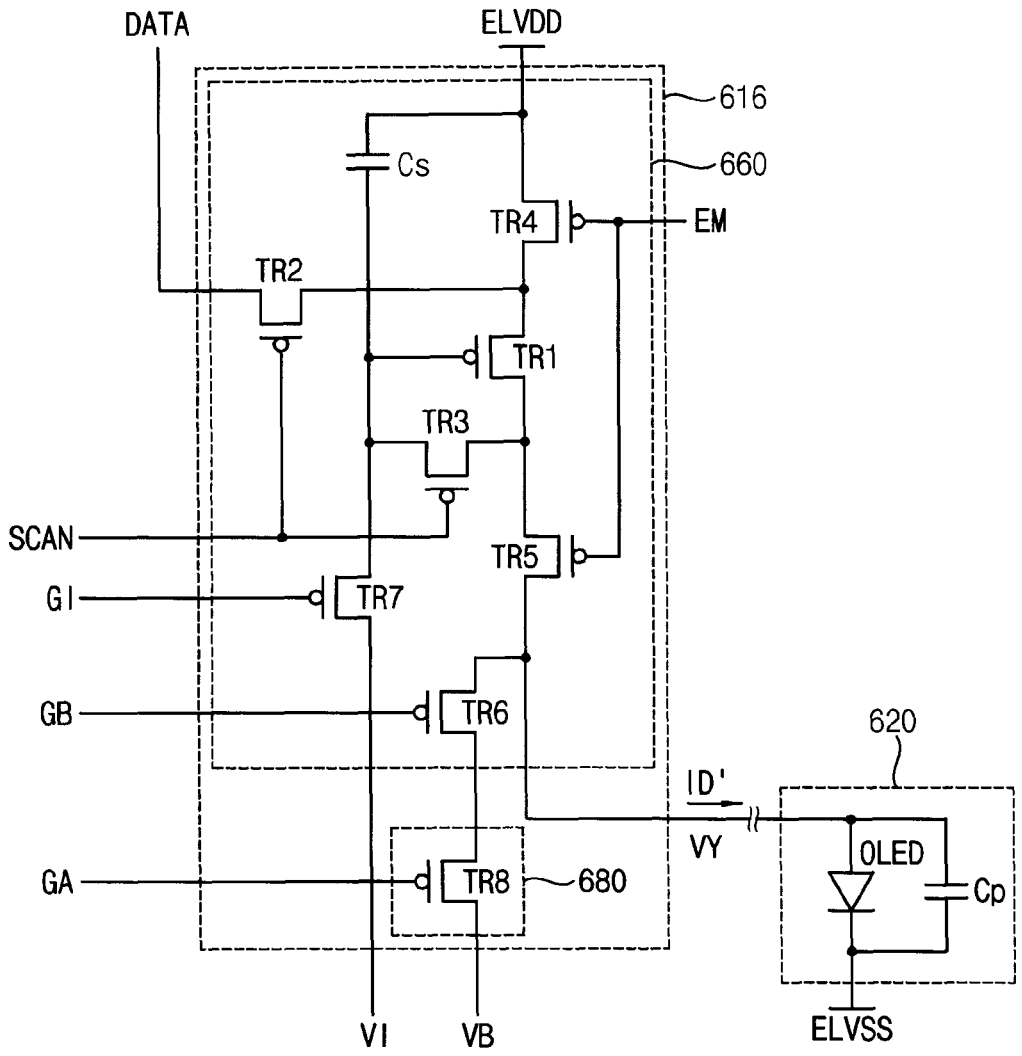
FIG. 7 is a circuit diagram illustrating another example of a repair pixel.

FIG. 7 is a circuit diagram illustrating another example of a repair pixel.

Referring to FIG. 7, a driving current providing part of FIG. 6 can be deactivated. A repair driving current providing part 660 provides a driving current ID' to the emission part 620 instead of the deactivated driving current providing part. A repair pixel 616 includes a repair driving current providing part 660 and an aging switch 680. The emission part 620 includes an OLED and a capacitor Cp. In one example embodiment, the structure of the repair driving current providing part 660 is substantially the same as a structure of the driving current providing part. The repair driving current providing part 660 includes a driving transistor TR1, a data applying transistor TR2, a threshold voltage compensation transistor TR3, a storage capacitor Cs, a first emission controlling transistor TR4, a second emission controlling transistor TR5, a first initialization controlling transistor TR6 and a second initialization controlling transistor TR7. The aging switch 680 includes a switching transistor TR8.

The OLED includes a first electrode and a second electrode to which a first power voltage ELVSS is applied. The OLED emits light based on the driving current ID'. The capacitor Cp is connected between the first electrode and the second electrode of the OLED. In one example embodiment, the capacitor Cp is a parasitic capacitor generated between the first electrode and the second electrode of the OLED.

The data applying transistor TR2 includes a gate electrode to which a scan signal SCAN is applied, a first electrode to which a data signal DATA is applied, and a second electrode connected to the first electrode of the driving transistor TR1. The data applying transistor TR2 applies the data signal DATA to the first electrode of the driving transistor TR1 when the scan signal SCAN is activated.

The threshold voltage compensation transistor TR3 includes a gate electrode to which the scan signal SCAN is applied, a first electrode connected to the second electrode of the driving transistor TR1, and a second electrode connected to the gate electrode of the driving transistor TR1. The threshold voltage compensation transistor TR3 connects the gate electrode of the driving transistor TR1 to the second electrode of the driving transistor TR1 when the scan signal is activated. The threshold voltage compensation transistor TR3 applies a compensated data voltage that is a voltage of the data signal DATA compensated based on the threshold voltage of the driving transistor TR1 to the storage capacitor Cs.

The storage capacitor Cs includes a first electrode to which the second power voltage ELVDD is applied and a second electrode connected to the gate electrode of the driving transistor TR1. The storage capacitor Cs stores the compensated data voltage for a certain period of time.

The driving transistor TR1 includes a gate electrode, a first electrode, and a second electrode. The driving transistor TR1 generates the driving current ID' based on the compensated data voltage.

The first emission controlling transistor TR4 includes a gate electrode to which an emission signal EM is applied, a first electrode to which the second power voltage ELVDD is applied, and a second electrode connected to the first electrode of the driving transistor TR1. The second emission controlling transistor TR5 includes a gate electrode to which the emission signal EM is applied, a first electrode connected to the second electrode of the driving transistor TR1, and a second electrode connected to the emission part 620. The first emission controlling transistor TR4 and the second emission controlling transistor TR5 provides the driving current ID' generated in the driving transistor TR1 to the emission part 620 based on the emission signal EM.

The switching transistor TR8 includes a gate electrode to which the aging signal GA is applied, a first electrode connected to the repair driving current providing part 660, and a second electrode to which the initialization voltage VB is applied. The aging signal GA is activated while the aging operation is performed. The aging signal GA is deactivated after the aging operation is finished. Thus, after the aging operation is finished, the switching transistor TR8 is turned off to prevent the initialization voltage VB from being applied to the repair driving current providing part 660.

The first initialization controlling transistor TR6 includes a gate electrode to which an initialization signal GB is applied, a first electrode to which the initialization voltage VB is applied, and a second electrode connected to the second electrode of the second emission controlling transistor TR5. In comparison with the driving current providing part of FIG. 6, the repair driving current providing part 660 is connected to the aging switch 680. The aging switch 680 can be turned off to prevent the initialization voltage VB from being applied after the aging operation is performed. Therefore, the initialization controlling transistor TR6 does not initialize a second current providing line voltage VY or a voltage of the second electrode of the second emission controlling transistor TR5 with the initialization voltage VB based on the initialization signal GB.

The second initialization controlling transistor TR7 includes a gate electrode to which a data initialization signal GI is applied, a first electrode to which a data initialization voltage VI is applied, and a second electrode connected to the gate electrode of the driving transistor TR1. The second initialization controlling transistor TR7 initializes the gate electrode of the driving transistor TR1 with a data initialization voltage VI based on the data initialization signal GI.

The aging voltage VA of FIG. 2 is applied instead of the initialization voltage VB when the aging operation is performed. Also, voltages having predetermined voltage levels are applied to the emission part 620 and the repair driving current providing part 660 instead of the first power voltage ELVSS, the second power voltage ELVDD, and the data initialization voltage VI when the aging operation is performed. In addition, transistors TR1 through TR7 included in the repair driving current providing part 660 operate the same as the transistors included in the driving current providing part of FIG. 4 while the aging operation is performed, such that the transistors have substantially uniform characteristics.

Figure 8:
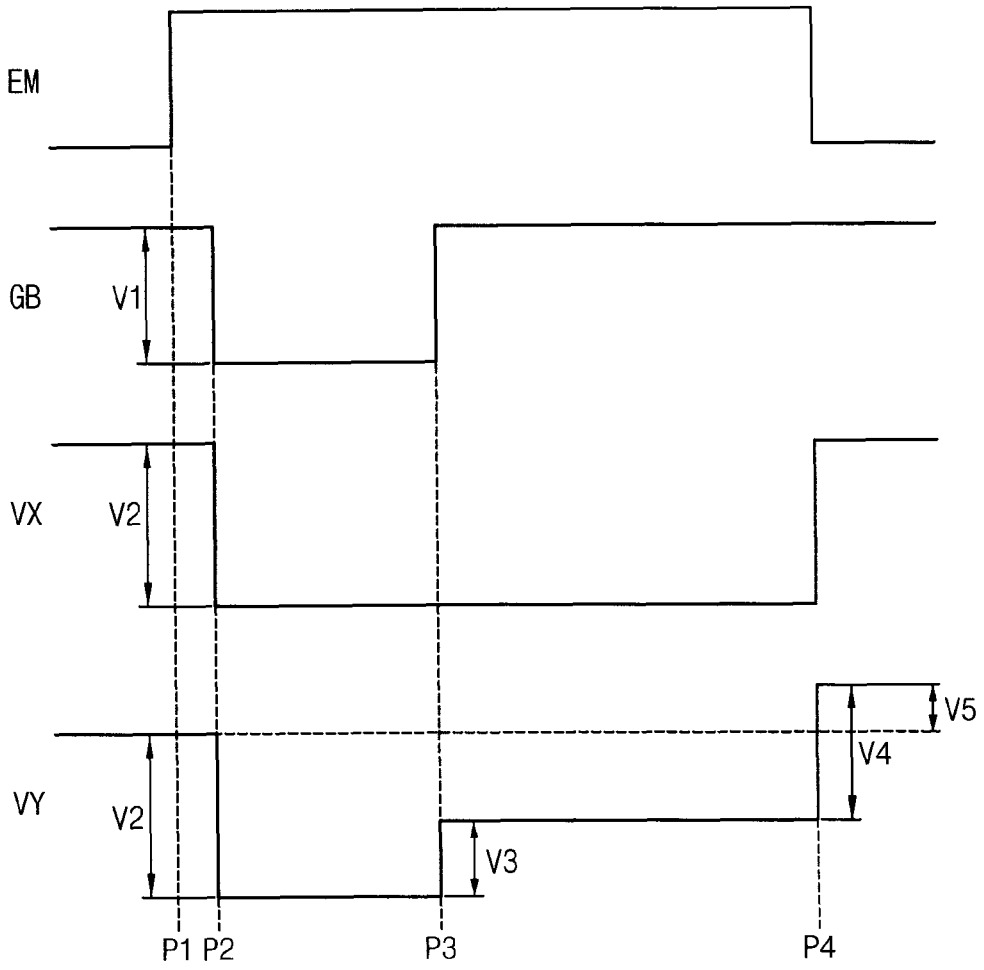
FIG. 8 is a waveform diagram illustrating voltages of a first current providing line and a second current providing line when an initial voltage is applied to a repair driving current providing part.

FIG. 8 is a waveform diagram illustrating voltages of a first current providing line and a second current providing line when an initial voltage is applied to a repair driving current providing part.

Referring to FIG. 8, an emission signal EM is inactive at a first time point P1. The emission signal EM is activated from the first time point T1 until a fourth time point P4. An initialization signal GB is decreased by a first change in voltage V1 at a second time point P2 (i.e., the initialization signal GB is activated). The initialization signal GB is increased by the first change in voltage V1 at a third time point P3 (i.e., the initialization signal GB is deactivated). A first current providing line voltage VX carries a voltage of the first current providing line connected between a driving current providing part of an active pixel and an OLED. The first current providing line voltage VX is decreased from a first voltage to an initialization voltage by a second change in voltage V2 at the second time point P2 in response to the change of the initialization signal GB. Also, the first current providing line voltage VX is increased by the second change in voltage V2 at the fourth time point P4 in response to the change of the emission signal EM. In addition, a second current providing line voltage VY carries a voltage of the second current providing line connected between a repair driving current providing part of a repair pixel and the OLED. The second current providing line voltage VY is decreased from the first voltage to the initialization voltage by the second change in voltage V2 at the second time point P2, is increased from the initialization voltage to a second voltage by a third change in voltage V3 at the third time point P3, and is increased from the second voltage to a third voltage by a fourth change in voltage V4 at the fourth time point P4.

At the second time point P2, the initialization signal GB is activated. Because the initialization voltage is provided to the driving current providing part and the repair driving current providing part, the first current providing line voltage VX and the second current providing line voltage VY are decreased from a first voltage to the initialization voltage by the second change in voltage V2.

At the third time point P3, the initialization signal GB is deactivated. Also, at the fourth time point P4, the emission signal EM is activated. While the emission signal EM is activated, the driving current flows through the OLED. Therefore, a voltage difference between both electrodes of the OLED may be similar to a threshold voltage of the OLED. Therefore, at the fourth time point P4, the first current providing line voltage VX is increased from the initialization voltage to the first voltage by the second change in voltage V2.

At the third time point P3, when the initialization signal GB is changed, the second current providing line voltage VY is increased by the third change in voltage V3 because of the coupling between the second current providing line voltage VY and the initialization line for providing initialization voltage. At the fourth time point P4, the second current providing line voltage VY is increased by the fourth change in voltage V4 because of the coupling between the second current providing line voltage VY and the first current providing line VX.

The capacitance of the parasitic capacitor generated between the first current providing line and peripheral elements is relatively small. Therefore, the first current providing line voltage VX may not be affected by voltage of the peripheral elements.

However, the capacitance of the parasitic capacitor generated between the second current providing line and peripheral elements is relatively large because the length of the second current providing line is longer than the length of the first current providing line. Therefore, the second current providing line voltage VY may experience greater effects from the peripheral elements in comparison with the first current providing line voltage VX.

Especially, when the first current providing line voltage VX is changed, the second current providing line voltage VY may be relatively greatly affected. In addition, when an initialization voltage providing line formed parallel to the second current providing line, the second current providing line voltage VY may be affected.

Thus, the second current providing line voltage VY may be boosted when the first current providing line voltage VX or the initialization voltage GB is changed. The boost amount of the second current providing line voltage VY may be determined according to following [Equation 1], $$\Delta\text{Boost} = \Delta V \times \frac{C_{parasitic}}{C_{total}} \qquad \text{EQUATION 1}$$

where Δ Boost is the boost amount of the second current providing line voltage, Δ V is voltage change of the peripheral elements, $C_{parasitic}$ is a capacitance of a parasitic capacitor generated between the second current providing line and a peripheral element, and $C_{total}$ is sum of parasitic capacitors generated by the second current providing line.

Therefore, at the third time point P3, when the initialization signal GB is increased by the first change in voltage V1, the second current providing line voltage VY is increased from the initialization voltage to the second voltage by the third change in voltage V3 based on [Equation 1]. At the fourth time period P4, when the first current providing line voltage VX is increased by the second change in voltage V2, the second current providing line voltage VY is increased from the second voltage to the third voltage by the fourth change in voltage V4 based on the [Equation 1].

Here, the second change in voltage V2 can be less than sum of the third change in voltage V3 and the fourth change in voltage V4. An over-current of which amount is larger than amount of the driving current may be applied to the OLED. The average amount of the over-current can be determined according to following [Equation 2], $$i_{over} = \frac{C_{total} \times V5}{T} \qquad \text{EQUATION 2}$$

where $i_{over}$ is the amount of over-current, $C_{total}$ is sum of parasitic capacitors generated by the second current providing line, V5 is a fifth change in voltage, and T is a frame period.

The larger the magnitude of the driving current, the greater the increase in luminance of the OLED. Therefore, the OLED may emit an unnecessarily excessively amount of light due to the over-current.

Figure 9:
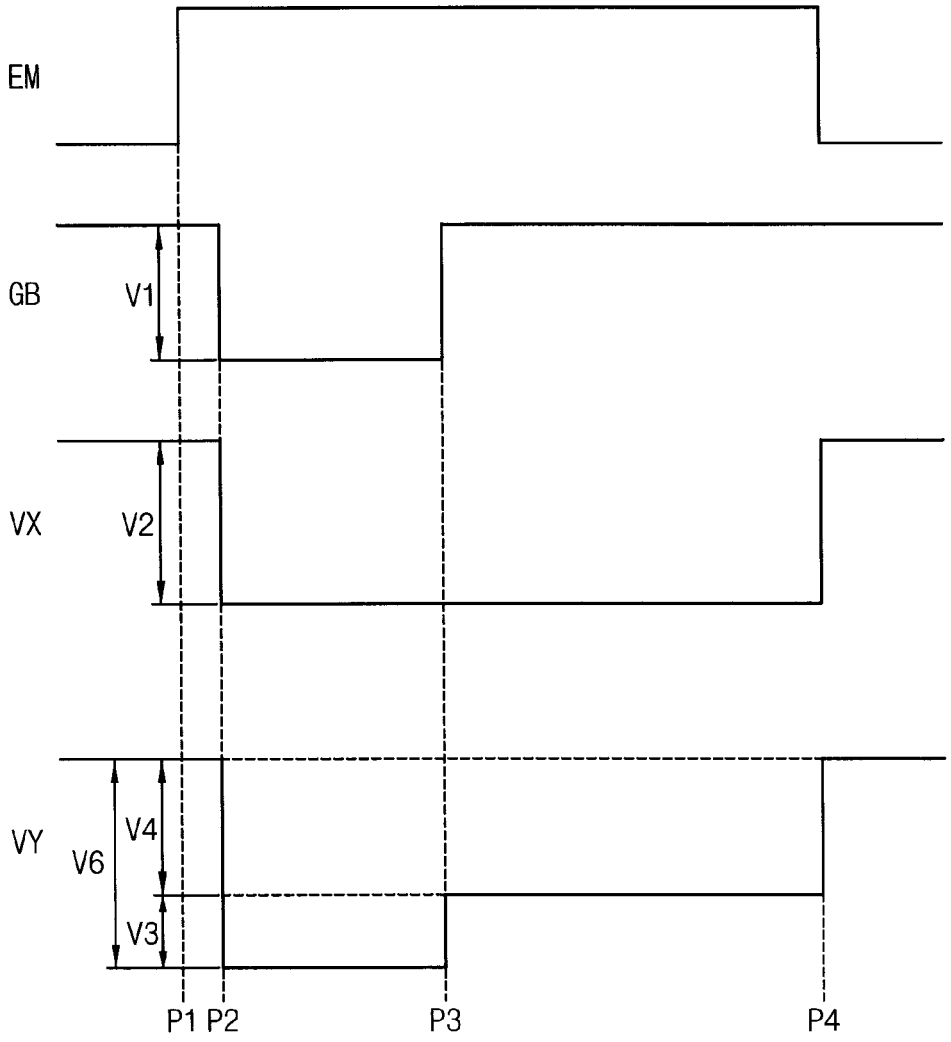
FIG. 9 is a waveform diagram illustrating voltages of a first current providing line and a second current providing line when an initial voltage is not applied to a repair driving current providing part.

FIG. 9 is a waveform diagram illustrating voltages of a first current providing line and a second current providing line when an initial voltage is not applied to a repair driving current providing part.

Referring to FIG. 9, an emission signal EM is deactivated at a first time point P1. The emission signal EM is activated at a fourth time point P4. An initialization signal GB is decreased by a first change in voltage V1 at a second time point P2 (i.e., the initialization signal GB is activated). The initialization signal GB is increased by a first change in voltage V1 at a third time point P3 (i.e., the initialization signal GB is deactivated). A first current providing line voltage VX carries a voltage of the first current providing line connected between a driving current providing part of an active pixel and an OLED. The first current providing line voltage VX is decreased from a first voltage to an initialization voltage by a second change in voltage V2 at the second time point P2 in response to change of the initialization signal GB. Also, the first current providing line voltage VX is increased by the second change in voltage V2 at the fourth time point P4 in response to change of the emission signal EM. In addition, a second current providing line voltage VY carries a voltage of the second current providing line connected between a repair driving current providing part of a repair pixel and the OLED. The second current providing line voltage VY is decreased from the first voltage to a fourth voltage by the sixth change in voltage V6 at the second time point P2. Also, the second current providing line voltage VY is increased from the fourth voltage to a fifth voltage by a third change in voltage V3 at the third time point P3 and is increased from the fifth voltage to the first voltage by the fourth change in voltage V4 at the fourth time point P4.

At the second time point P2, the initialization signal GB is activated. Because the initialization voltage is only provided to the driving current providing part, the first current providing line voltage VX is decreased from the first voltage to the initialization voltage by the second change in voltage V2.

At the second time point P2, when the first current providing line voltage VX is decreased by the second change in voltage V2, the second current providing line voltage VY is decreased by the fourth change in voltage V4 based on the above [Equation 1]. Also, when the initialization signal GB is decreased by the first change in voltage V1, the second current providing line voltage VY is decreased by the third change in voltage V3 based on the above [Equation 1]. Therefore, the second current providing line voltage VY is decreased by the sixth change voltage V6.

At the third time point P3, when the initialization signal GB is changed, the second current providing line voltage VY is increased from the fourth voltage to the fifth voltage by the third change in voltage V3 because of the coupling between the second current providing line voltage VY and a initialization line for providing initialization voltage. At the fourth time point P4, the second current providing line voltage VY is increased from the fifth voltage to the first voltage by the fourth change in voltage V4 because of the coupling between the second current providing line voltage VY and the first current providing line.

Therefore, when the second current providing line is not initialized to the initialization voltage, the boost voltage of the second current providing line generated by peripheral elements can be self-canceled, thereby preventing excessive light emission.

Although the example embodiments describe that the pixels include transistors are implemented as PMOS transistors, the transistors also can be implemented various types.

The described technology can be applied to an electronic device having an OLED display. For example, the described technology be applied to a television, a computer monitor, a laptop, a cellular phone, a smart phone, a smart pad, a personal digital assistant (PDA), a portable multimedia player (PMP), a MP3 player, a navigation system, a game console, a video phone, etc.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the inventive technology. Accordingly, all such modifications are intended to be included within the scope of the invention as defined in the claims. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

What is claimed is:

1. A display panel, comprising:

an active pixel including: i) a driving circuit configured to generate a driving current based on a data signal and ii) an emission circuit comprising an organic light-emitting diode (OLED) configured to emit light based on the driving current; and a repair pixel comprising:

a repair driving circuit configured to provide a repair driving current to the OLED instead of the driving current of the driving circuit when the driving circuit is disconnected from the OLED; and an aging switch electrically connected to a power supply that is configured to generate an aging voltage, wherein the aging switch is configured to: i) apply the aging voltage to the repair driving circuit during an aging operation for the active pixel and the repair pixel and ii) electrically disconnect the repair driving circuit from the power supply after the aging operation is performed, wherein the aging switch is not directly connected to the OLED, wherein, during the aging operation, both of the driving circuit of the active pixel and the repair driving circuit of the repair pixel receive the aging voltage from the power supply, and wherein, after the aging operation is performed, the driving circuit of the active pixel receives an initialization voltage from the power supply, and the repair driving circuit of the repair pixel does not receive the initialization voltage from the power supply.

2. The display panel of claim 1, wherein the OLED includes a first electrode and a second electrode configured to receive a first power voltage, and wherein the emission circuit further comprises a capacitor connected between the first electrode and the second electrode of the OLED.

3. The display panel of claim 1, wherein the structure of the repair driving circuit is substantially the same as the structure of the driving circuit.

4. The display panel of claim 3, wherein the driving circuit and the repair driving circuit are each configured to receive the aging voltage during the aging operation.

5. The display panel of claim 4, wherein a first transistor included in the driving circuit and a second transistor included in the repair driving circuit are each configured to receive the aging voltage.

6. The display panel of claim 3, wherein each of the driving circuit and the repair driving circuit includes:

a driving transistor including a gate electrode, a first electrode configured to receive a second power voltage, and a second electrode;

a data switching transistor including a gate electrode configured to receive a scan signal, a first electrode configured to receive the data signal, and a second electrode connected to the gate electrode of the driving transistor;

a storage capacitor including a first electrode configured to receive the second power voltage and a second electrode connected to the gate electrode of the driving transistor;

an emission control transistor including a gate electrode configured to receive an emission signal, a first electrode connected to the second electrode of the driving transistor, and a second electrode connected to the emission circuit; and an initialization control transistor including a gate electrode configured to receive an initialization signal, a first electrode configured to receive an the initialization voltage, and a second electrode connected to the second electrode of the emission control transistor.

7. The display panel of claim 6, wherein the data switching transistor is configured to apply the data signal to the storage capacitor when the scan signal is activated, wherein the storage capacitor is configured to store the data signal, wherein the driving transistor is configured to generate the driving current based on the stored data signal, wherein the emission control transistor is configured to provide the generated driving current to the emission circuit based on the emission signal, and wherein the initialization control transistor is configured to initialize the second electrode of the emission control transistor to the initialization voltage based on the initialization signal.

8. The display panel of claim 3, wherein each of the driving circuit and the repair driving circuit includes:

a driving transistor including a gate electrode, a first electrode, and a second electrode;

a data switching transistor including a gate electrode configured to receive a scan signal, a first electrode configured to receive the data signal, and a second electrode connected to the first electrode of the driving transistor;

a threshold voltage compensation transistor including a gate electrode configured to receive the scan signal, a first electrode connected to the second electrode of the driving transistor, and a second electrode connected to the gate electrode of the driving transistor;

a storage capacitor including a first electrode configured to receive a second power voltage and a second electrode connected to the gate electrode of the driving transistor;

a first emission control transistor including a gate electrode configured to receive an emission signal, a first electrode configured to receive the second power voltage, and a second electrode connected to the first electrode of the driving transistor;

a second emission control transistor including a gate electrode configured to receive the emission signal, a first electrode connected to the second electrode of the driving transistor, and a second electrode connected to the emission circuit;

a first initialization control transistor including a gate electrode configured to receive an initialization signal, a first electrode configured to receive the initialization voltage, and a second electrode connected to the second electrode of the second emission control transistor; and a second initialization control transistor including a gate electrode configured to receive a data initialization signal, a first electrode configured to receive a data initialization voltage, and a second electrode connected to the gate electrode of the driving transistor.

9. The display panel of claim 8, wherein the data switching transistor is configured to apply the data signal to the first electrode of the driving transistor when the scan signal is activated, wherein the threshold voltage compensation transistor is configured to connect the gate electrode of the driving transistor to the second electrode of the driving transistor when the scan signal is activated, wherein the threshold voltage compensation transistor is further configured to i) compensate the data signal based on the threshold voltage of the driving transistor so as to generate a compensated data voltage and ii) apply the compensated data voltage to the storage capacitor, wherein the storage capacitor is configured to store the compensated data voltage, wherein the driving transistor is configured to generate the driving current based on the compensated data voltage, wherein the first and second emission control transistors are configured to provide the generated driving current to the emission circuit based on the emission signal, wherein the first initialization control transistor is configured to initialize the second electrode of the second emission control transistor to the initialization voltage based on the initialization signal, and wherein the second initialization control transistor is configured to initialize the gate electrode of the driving transistor to the data initialization voltage based on the data initialization signal.

10. The display panel of claim 8, wherein the initialization signal is substantially the same as the data initialization signal.

11. The display panel of claim 8, wherein the initialization voltage is substantially the same as the data initialization voltage.

12. An organic light-emitting diode (OLED) display, comprising:

a display panel including a repair pixel and an active pixel;

a power supply configured to apply an aging voltage and an initialization voltage to each of the active pixel and the repair pixel;

a scan driver configured to provide a scan signal to each of the active pixel and the repair pixel;

a data driver configured to provide a data signal to each of the active pixel and the repair pixel when the scan signal is activated; and a timing controller configured to control the scan driver and the data driver, wherein the active pixel includes:

an emission circuit comprising an OLED configured to emit light based on a driving current; and a driving circuit configured to provide the driving current to the OLED based on the data signal, wherein the repair pixel includes:

a repair driving circuit configured to provide a repair driving current to the OLED instead of the driving current of the driving current circuit when the driving current circuit is disconnected from the OLED; and an aging switch electrically connected to the power supply and configured to: i) apply the aging voltage to the repair driving circuit during an aging operation for the active pixel and the repair pixel and ii)

electrically disconnect the repair driving circuit from the power supply after the aging operation is performed, wherein the aging switch is not directly connected to the OLED, wherein, during the aging operation, both of the driving circuit of the active pixel and the repair driving circuit of the repair pixel receive the aging voltage from the power supply, and wherein, after the aging operation is performed, the driving circuit of the active pixel receives the initialization voltage from the power supply, and the repair driving circuit of the repair pixel does not receive the initialization voltage from the power supply.

13. The display of claim 12, wherein the OLED includes a first electrode and a second electrode configured to receive a first power voltage, and wherein the emission circuit further comprises a capacitor connected between the first electrode and the second electrode of the OLED.

14. The display of claim 12, wherein the structure of the repair driving circuit is substantially the same as the structure of the driving circuit.

15. The display of claim 14, wherein the power supply is further configured to apply the aging voltage to the driving circuit and the repair driving circuit during the aging operation.

16. The display of claim 15, wherein the power supply is further configured to apply the aging voltage to a first transistor included in the driving circuit and a second transistor included in the repair driving circuit.

17. The display of claim 14, wherein each of the driving circuit and the repair driving circuit includes:

a driving transistor including a gate electrode, a first electrode configured to receive a second power voltage, and a second electrode;

a data switching transistor including a gate electrode configured to receive the scan signal, a first electrode configured to receive the data signal, and a second electrode connected to the gate electrode of the driving transistor;

a storage capacitor including a first electrode configured to receive the second power voltage and a second electrode connected to the gate electrode of the driving transistor;

an emission control transistor including a gate electrode configured to receive an emission signal, a first electrode connected to the second electrode of the driving transistor, and a second electrode connected to the emission circuit; and an initialization control transistor including a gate electrode configured to receive an initialization signal, a first electrode configured to receive an the initialization voltage, and a second electrode connected to the second electrode of the emission control transistor.

18. The display of claim 17, wherein the data switching transistor is configured to apply the data signal to the storage capacitor when the scan signal is activated, wherein the storage capacitor is configured to store the data signal, wherein the driving transistor is configured to generate the driving current based on the stored data signal, wherein the emission control transistor is configured to provide the generated driving current to the emission circuit based on the emission signal, and wherein the initialization control transistor is configured to initialize the second electrode of the emission control transistor based on the initialization signal.

19. The display of claim 14, wherein each of the driving circuit and the repair driving circuit includes:

a driving transistor including a gate electrode, a first electrode, and a second electrode;

a data switching transistor including a gate electrode configured to receive the scan signal, a first electrode configured to receive the data signal, and a second electrode connected to the first electrode of the driving transistor;

a threshold voltage compensation transistor including a gate electrode configured to receive the scan signal, a first electrode connected to the second electrode of the driving transistor, and a second electrode connected to the gate electrode of the driving transistor;

a storage capacitor including a first electrode configured to receive a second power voltage and a second electrode connected to the gate electrode of the driving transistor;

an emission control transistor including a gate electrode configured to receive the emission signal, a first electrode connected to the second electrode of the driving transistor, and a second electrode connected to the emission circuit;

a first initialization control transistor including a gate electrode configured to receive an initialization signal, a first electrode configured to receive the initialization voltage, and a second electrode connected to the second electrode of the emission control transistor; and a second initialization control transistor including a gate electrode configured to receive a data initialization signal, a first electrode configured to receive a data initialization voltage, and a second electrode connected to the gate electrode of the driving transistor.

20. The display of claim 19, wherein the data switching transistor is configured to apply the data signal to the first electrode of the driving transistor when the scan signal is activated, wherein the threshold voltage compensation transistor is configured to connect the gate electrode of the driving transistor to the second electrode of the driving transistor when the scan signal is activated, wherein the threshold voltage compensation transistor is further configured to i) compensate the data signal based on the threshold voltage of the driving transistor so as to generate a compensated data voltage and ii) apply the compensated data voltage to the storage capacitor, wherein the storage capacitor is configured to store the compensated data voltage, wherein the driving transistor is configured to generate the driving current based on the compensated data voltage, wherein the emission control transistor is configured to provide the generated driving current to the emission circuit based on the emission signal, wherein the first initialization control transistor is configured to initialize the second electrode of the emission control transistor based on the initialization signal, and wherein the second initialization control transistor is configured to initialize the gate electrode of the driving transistor based on the data initialization signal.

* * * * *